United States Patent [19]

Korn et al.

[11] 4,176,275

[45] Nov. 27, 1979

[54] RADIATION IMAGING AND READOUT SYSTEM AND METHOD UTILIZING A MULTI-LAYERED DEVICE HAVING A PHOTOCONDUCTIVE INSULATIVE LAYER

[75] Inventors: Donald M. Korn, Denmark Township, Washington County; Owen L. Nelson, St. Paul, both of Minn.

[73] Assignee: Minnesota Mining and Manufacturing Company, St. Paul, Minn.

[21] Appl. No.: 826,369

[22] Filed: Aug. 22, 1977

[51] Int. Cl.[2] ..... H01J 31/50

[52] U.S. Cl. ..... 250/213 R; 250/370

[58] Field of Search ..... 250/213 R, 213 VT, 370; 313/384, 385, 391

[56] References Cited

U.S. PATENT DOCUMENTS

| | | | |
|---|---|---|---|
| 2,972,082 | 2/1961 | Kallman et al. | 313/384 |
| 3,483,320 | 12/1969 | Gebel | 313/384 |
| 3,970,844 | 7/1976 | Fenn et al. | 250/213 VT |
| 4,085,327 | 4/1978 | Swank et al. | 250/370 |

*Primary Examiner*—David C. Nelms

*Attorney, Agent, or Firm*—Cruzan Alexander; Donald M. Sell; Robert L. Marben

[57] ABSTRACT

An imaging system and method in which a multi-layered device having a photoconductive insulative layer is utilized to provide an electrostatic charge image at a layer of the device in response to imaging radiation directed to the device. A scanner for scanning the device with readout radiation is used with readout electronics for converting the electrostatic charge image to electrical signals. A D.C. voltage source is used during the imaging step to impress an electric field across the device and is also used to provide an electric field across the device and support charge flow initiated by the readout radiation during the readout step. Devices using a fluid layer that absorbs x-rays to produce electrons and ions are used in the system with x-ray imaging radiation with a conductive layer that is associated with the fluid layer re-positioned closer to the photoconductive insulative layer after the electrostatic charge image has been formed.

14 Claims, 14 Drawing Figures

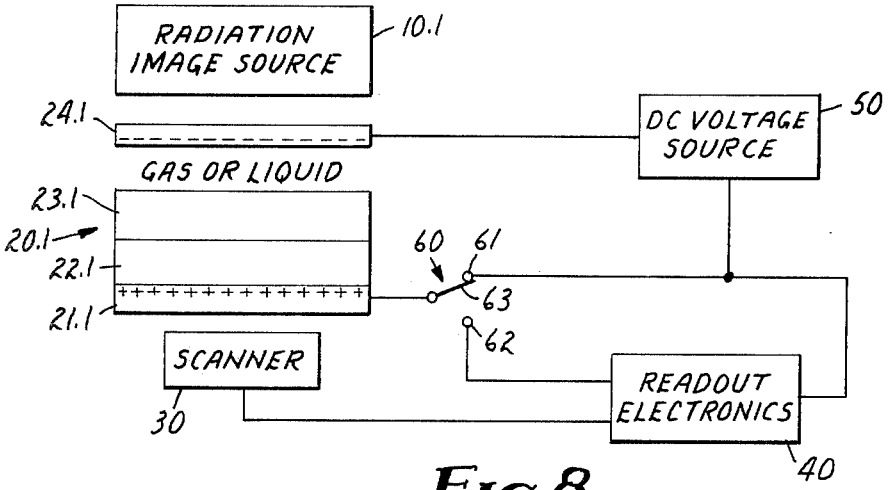
FIG. 8
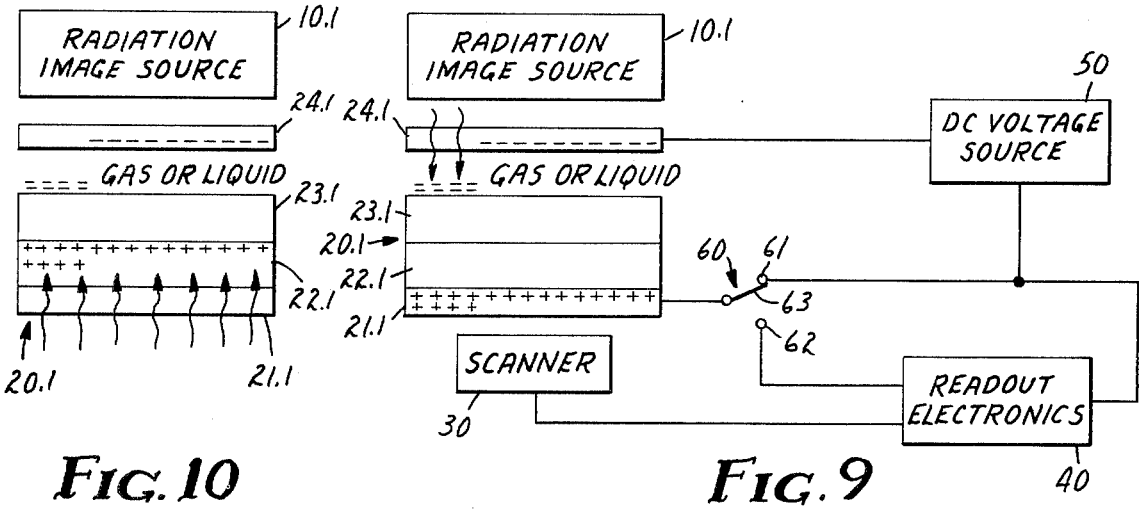
FIG. 10
FIG. 9
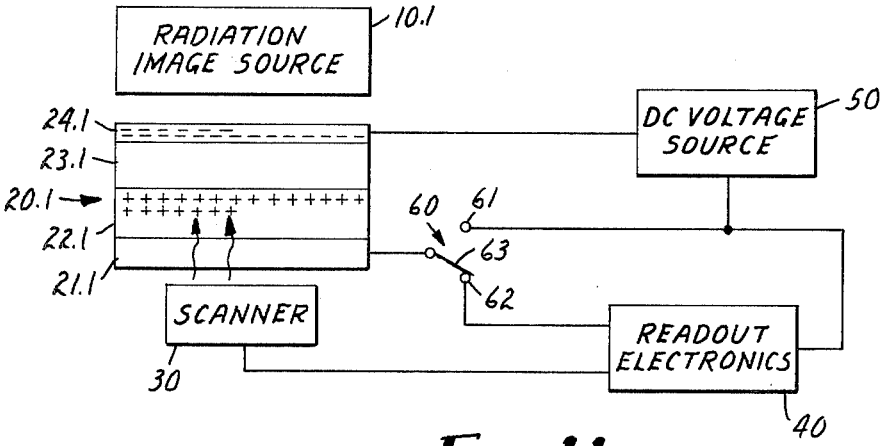
FIG. 11

RADIATION IMAGING AND READOUT SYSTEM AND METHOD UTILIZING A MULTI-LAYERED DEVICE HAVING A PHOTOCONDUCTIVE INSULATIVE LAYER

BACKGROUND OF THE INVENTION

1. Field of the Invention

The invention relates to an imaging system and method in which an imaging device is used to provide an electrostatic charge image in accordance with the varying amount of incident light or x-ray energy received by the device, the system and method providing for the conversion of the electrostatic charge image into electrical signals usable for producing the image in a visible form.

2. Description of the Prior Art

Radiation sensitive devices referred to as metal insulator semiconductor type (MIS) or metal oxide semiconductor (MOS) devices are disclosed in U.S. Pat. Nos. 3,497,698 and 3,746,867 to Robert J. Phelan, Jr. et al. These devices require a substantial charge accumulation (depletion) region in an n-type (p-type) semiconductor layer adjacent the dielectric layer. Imaging radiation absorbed in this narrow accumulation (depletion) region produces charge carriers which must be capable of being transferred into the dielectric and, as a result, transform the charge accumulation (depletion) region into a charge depletion (accumulation) region. Electronic detection of the change in the nature of this narrow region of the semiconductor adjacent to the dielectric is accomplished by scanning a radiation beam across this interface and detecting a resulting photo-voltaic electrical signal that is indicative of the original imaging radiation. This device has limited utility since practical devices are small (a few cm.$^2$ at most) and preferably operated at very low temperatures. Also, since only charges photo-generated in the narrow charge accumulation region are transferred into the dielectric, the device is relatively insensitive to highly penetrating imaging radiation such as x-rays.

A radiation sensitive device in the form of a conductor-insulator-semiconductor (CIS) structure is used as the storage element of the device disclosed in U.S. Pat. No. 3,916,268 to William E. Engeler. This storage element is provided with an initial charge which is then modified by the generation of minority carriers in the semiconductor in response to application of radiation to the device. The change in the charge is a measure of the integrated radiation energy. Readout of the charge then present is made by electronically interrogating the device causing the device to discharge providing an electrical signal indicative of the charge that was present. A measure of radiation that has been applied to various portions of an area can only be obtained by using a large number of the devices within such area which can be formed in an integrated array on a substrate. The devices of the array can be sequentially addressed and discharged subsequent to a charging time-interval to obtain an electric readout of the incident radiation each device received.

U.S. Pat. No. 3,970,844 to John B. Fenn, Jr. et al discloses a system in which an electrostatic charge image is found at the surface of a photoconductive layer in accordance with the x-ray energy absorbed by an ion emitting medium, such as gas, located between the x-ray source and the photoconductive layer. An electrode is positioned between the ion emitting medium and the x-ray source. While the x-ray energy is presented, an imaging power supply is connected between the electrode and an optically transparent conductive layer carried by the surface of the photoconductive layer away from the x-ray source causing the electrostatic charge image to be formed at the surface of the photoconductive layer. The imaging power supply is then disconnected. Readout electronics are connected to the conductive layer for receiving signals corresponding to the magnitude of charge at various points on the photoconductive layer in response to the scanning of the photoconductive layer by a light source operated under the control of the readout electronics. Several different scanning methods are disclosed. The system requires that the photoconductive layer be non-x-ray absorbing or that a layer of x-ray absorbing material be positioned at the surface of the photoconductive layer adjacent the ion emitting medium, the material being electrically anisotropic so the charge image is transferred to the photoconductive layer.

SUMMARY OF THE INVENTION

The present invention provides a system and method for establishing an electrostatic charge image and a readout of the image which includes the use of a multi-layered photoconductive device, a D.C. voltage source connected across the device to provide a high electric field across the device while a radiation source is used to expose the device to a radiation image to produce an electrostatic image at a layer of the device and a scanner for scanning the device with readout radiation while readout electronics and the D.C. voltage source are connected in series across the device. In one embodiment, the device may include a first conductive layer, an insulative layer, a photoconductive insulative layer and a second conductive layer in that order wherein the successive layers are contiguous when the system uses light or x-rays to provide a radiation image. The use of the D.C. voltage source during readout provides a source to support the charge flow that is initiated by the readout radiation directed to a portion of the device. Such charge flow is detected by the readout electronics, since it is in series with the D.C. voltage source.

When an x-ray source provides the radiation image, a device can be used wherein the latter three layers of the device are successively contiguous with the first conductive layer spaced from the insulative layer, with such space filled with a fluid, such as a gas or liquid, that absorbs x-rays to produce electrons and ions. During readout of the electrostatic charge image provided by this device, the conductive layer is positioned close to or contiguous with the insulative layer. In the case where the first conductive layer is to be brought into direct electrical contact with the insulative layer for obtaining a readout of the electrostatic image, this device is temporarily isolated from the D.C. voltage source while it is flooded with radiation to cause the electrical charges at the second conductive layer to migrate to the photoconductive insulative layer/insulator layer interface. Rather than bringing the first conductive layer into electrical contact with the insulative layer, the first conductive layer can be positioned close to the insulative layer allowing elimination of the steps otherwise requiring the device to be isolated from the D.C. voltage source and flooded with radiation. It is also possible with such positioning of the first conductive layer to use a device utilizing fluid spacing wherein the insulative layer is not used as a part of the device structure.

Another arrangement for a device that can be utilized in the system and method of this invention involves a multi-layered device as initially described, but with a second photoconductive insulating layer between the first conductive layer and the insulative layer. The second photoconductive layer is used to respond to the imaging radiation, while the other photoconductive layer is provided for responding to the readout radiation.

The multi-layered device used in the system of the present invention permits the use of any of a wide variety of organic or inorganic photoconductive insulators as one of the layers whose form may be amorphous, crystalline or binder coated particulates allowing the device to be made having larger imaging areas than is possible with a semiconductor type device and providing a device having large exposure latitude.

The present invention utilizes a multi-layered device that can operate effectively at room temperature with its operation not dependent on the existence of a charge depletion or charge accumulation region in the radiation responsive layer.

Further, the device utilized in the present invention is not dependent on the existence of surface states or electronic states in a dielectric to store charges in response to the imaging radiation.

In addition, the multi-layered device utilized in the present invention provides an active depth of sensitivity that is not determined by the thickness of a charge accumulation or charge depletion region, but is determined by the thickness of the radiation sensitive layer, which layer provides an active sensitive thickness that is sufficiently deep so as to be sensitive to highly penetrating radiation such as x-rays and provides high sensitivity to a wide range of imaging radiation.

The multi-layered device utilized in the present invention is reusable being readily erased by the radiation used for imaging or readout and can be provided with separate imaging and readout radiation sensitive layers for special applications.

The multi-layered device utilized in the present invention permits an electrostatic charge image to be formed in response to time integrated imaging radiation with such charge formation possible for either polarity of the electric field that is used when forming the charge image.

Other features and advantages of the invention will be apparent from the detailed description when read with the accompanying drawings:

Figure 1:
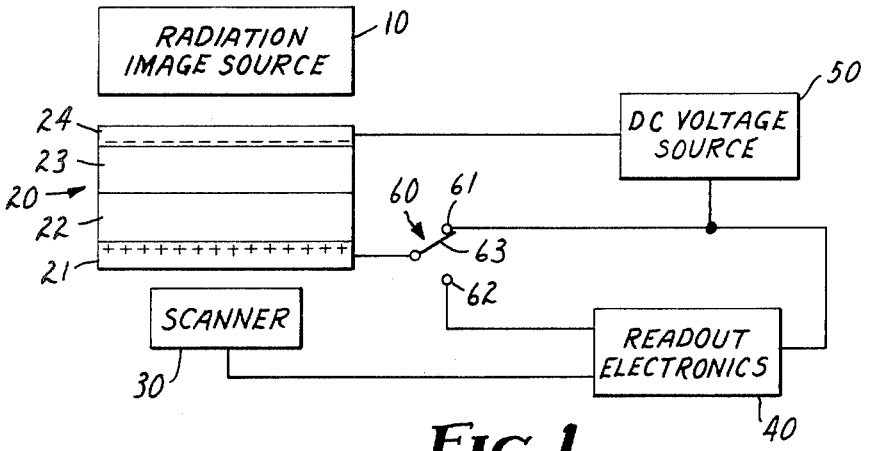
FIG. 1 is a diagrammatic view of a system embodying the invention and depicts the charge distribution presented during a step of the method of the invention.
Figure 2:
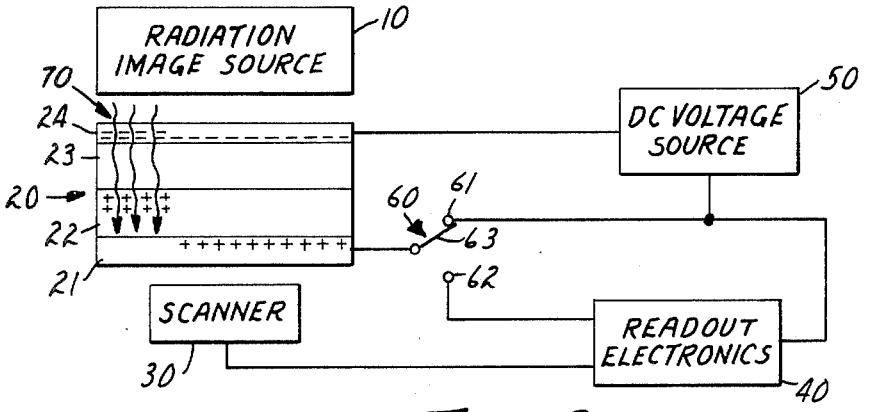
FIGS. 2 and 3 are similar to FIG. 1 and depict other steps in the method together with a diagrammatic showing of the charge distribution presented during such steps.
Figure 3:
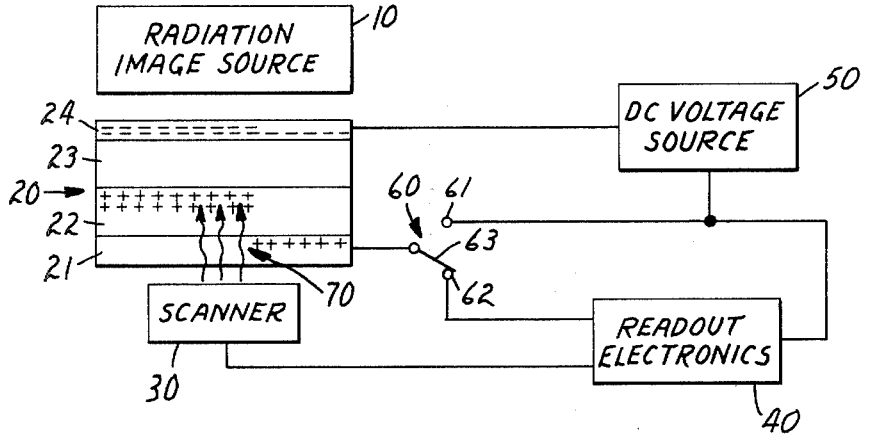
Figure 4:
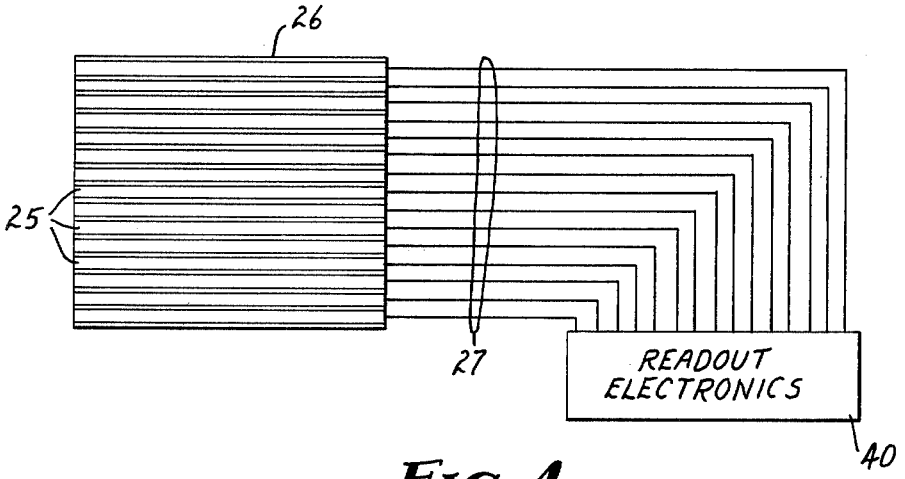
FIG. 4 is a plan view of one structure for the lower layer of the multi-layered device of FIG. 1.
Figure 4A:
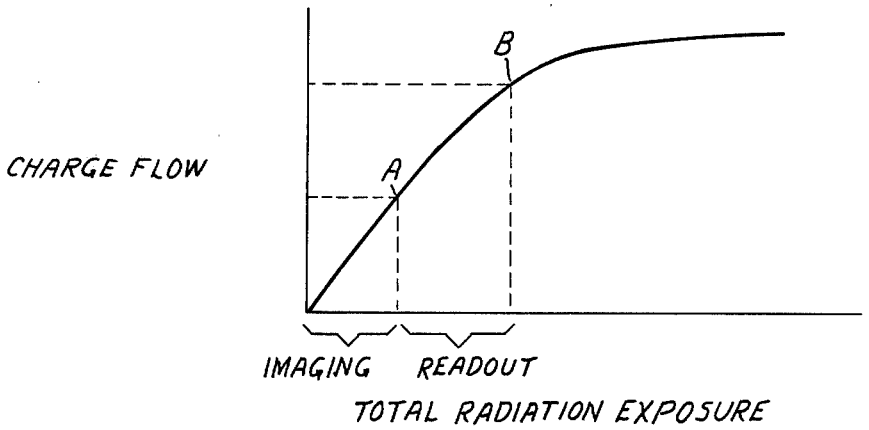
Figure 5:
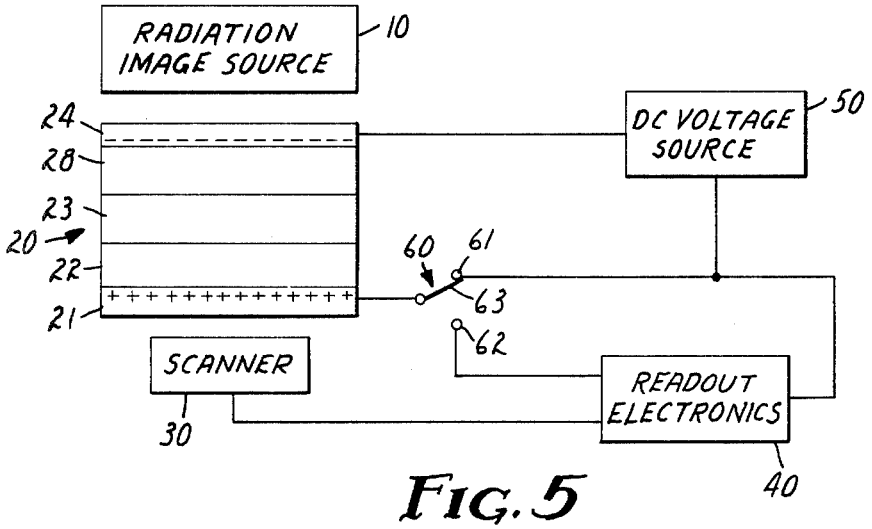
Figure 6:
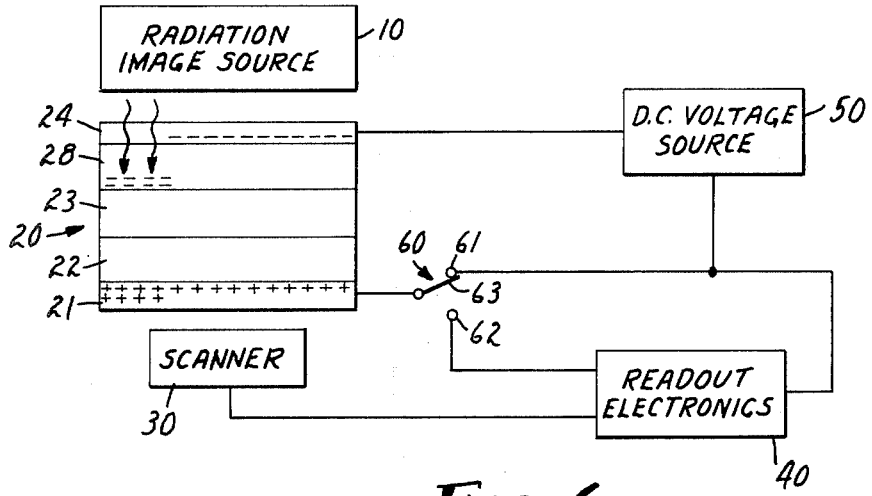
Figure 7:
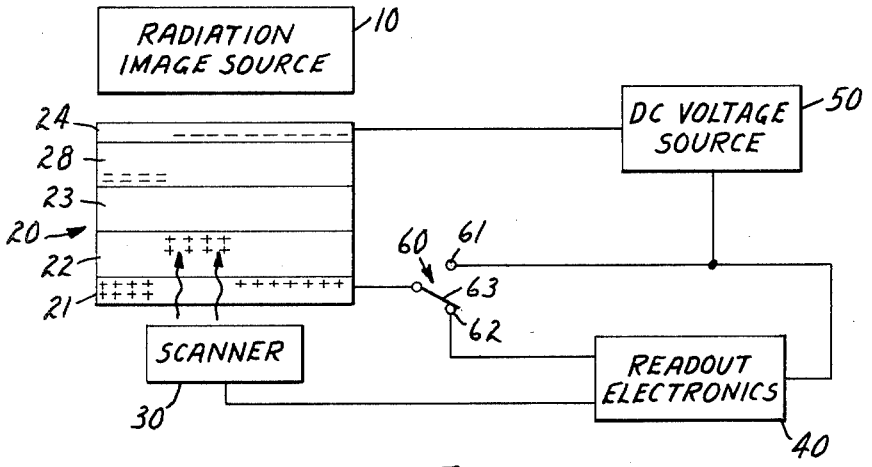
Figure 12:
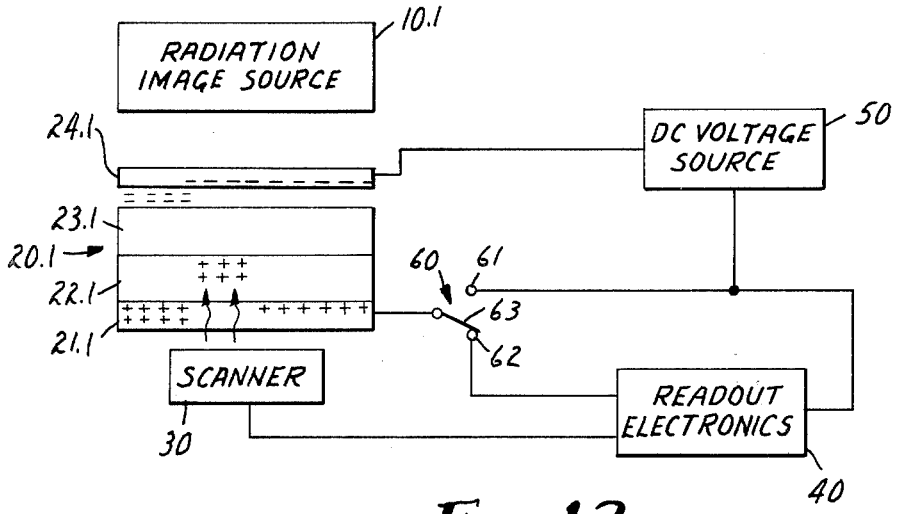
Figure 13:
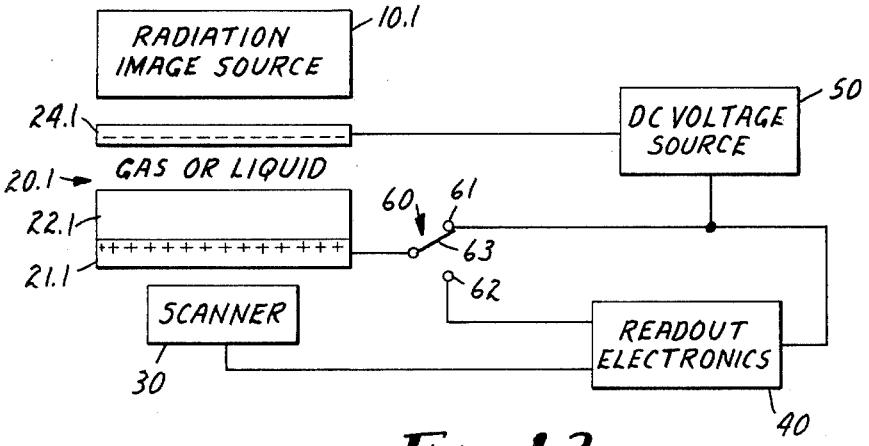

FIG. 4*a* is a pictorial showing of charge flow versus total radiation exposure for devices used;

FIGS. 5, 6 and 7 provide a diagrammatic showing similar to FIGS. 1–3 for another system and method embodying the invention;

FIGS. 8, 9, 10 and 11 provide a diagrammatic showing of a further system and method embodying the invention;

FIG. 12 together with FIGS. 8 and 9 provides a diagrammatic showing of another system and method embodying the invention; and FIG. 13 is a diagrammatic showing of a further system embodying the invention.

DETAILED DESCRIPTION

Referring to FIG. 1, one embodiment of the invention is shown which includes a radiation image source 10 positioned for directing a radiation image onto the upper surface of a radiation sensitive imaging device 20. The radiation image may be provided by light or x-rays.

The imaging device (not drawn to scale) comprises a unitary sandwich of contiguous layers which include a first conductor layer 24, an insulative layer 23, a photoconductive insulative layer 22, and a second conductor layer 21. The layer 21 or 24 can provide the surface to which the radiation image is directed and, when so used, must be substantially transparent to the radiation energy provided from the radiation image source 10. In FIG. 1 the device is arranged so layer 24 receives the radiation image. In this case, the insulative layer 23 must also be substantially transparent to the radiation energy used so it can reach the photoconductive insulative layer 22.

A scanner 30 is provided which operates under the control of readout electronics 40 to provide readout radiation which is progressively directed to areas of the outer surface of conductor layer 21 or 24 to scan the imaging device when the system is operated in the readout mode. In FIG. 1 the device is arranged so the readout radiation is directed at layer 21. The layer selected for receiving scanning radiation, as well as other layers through which the radiation must pass to reach the photoconductive layer 22, must be of a material that is substantially transparent to the scanning radiation that is used.

A D.C. voltage source 50 is provided to apply a uniform high electric field across the device 20 and is arranged so it can be connected directly across the imaging device 20 or in series with the readout electronics across the imaging device 20. The two possible connections for the D.C. voltage source 50 is schematically shown by the use of the switch 60 having two fixed contacts 61 and 62 plus a movable contact 63. The movable contact 63 is connected to the conductor layer 21 while fixed contact 61 is connected to the D.C. voltage source 50 and the readout electronics 40. Fixed contact 62 is connected to the readout electronics 40. With the switch 60 positioned so the movable contact 63 is in contact with the fixed contact 61, the D.C. voltage source is connected directly between the conductor layers 21 and 24. When contact 63 is in contact with contact 62, the conductor layers 21 and 24 are connected together via the D.C. voltage source 50 in series with the readout electronics 40. It can be appreciated that switch 60 need not be used if the readout electronics 40 is designed to handle the charging current that flows when the D.C. voltage is initially applied to the device 20.

The system shown in FIG. 1 provides the means for carrying out the method of this invention for obtaining an electrostatic charge image by exposing the device 20 to a radiation image which can subsequently be converted into electronic signals by scanning the device 20 by readout radiation provided by the scanner 30. The operation of the scanner is coordinated with operation of the readout electronics enabling the position of each portion of the electrostatic charge image that is interrogated to be properly correlated with the electrical signal that is obtained from such interrogation.

The method requires that the device 20 be sensitized for responding to a radiation image to be provided by the radiation source 10. The device is sensitized by providing a uniform high electrical field between the outer surfaces of the insulative layer 23 and the photoconductive insulative layer 22. For the device 20, as shown in FIG. 1, this is accomplished by connecting the D.C. voltage source 50 directly between the conductor layers 21 and 24. The polarity of the voltage that is applied may be dictated by the material used for the photoconductive layer 22. For purposes of illustration, the D.C. voltage source 50 is connected so that layer 21 is positive with respect to layer 24. Switch 60 is positioned as shown in FIG. 1 to establish this condition. The electrical charge distribution established is diagrammatically shown in FIG. 1.

With the device so sensitized, and the D.C. voltage source remaining connected to the device 20, the radiation imaging source is operated to expose the device to a radiation image, the radiation of which is absorbed by the photoconductive insulative layer 22 causing the conductivity of absorbing areas to increase allowing the charges at the outer surface of the photoconductor layer for areas where the radiation is absorbed to move to the inner surface of the photoconductive layer to establish an electrostatic charge image of the radiation image at the upper surface of the photoconductive layer. Since this increased conductivity of such areas of the photoconductor can be viewed as reducing the effective thickness of the capacitor provided between the two conductor layers 21 and 24, the presentment of the uniform D.C. voltage at the outer surface of the insulator layer 24 requires that additional charge flow in the areas where radiation energy is absorbed. The D.C. voltage level and the total exposure to radiation at a given area of the photoconductive layer will determine the amount of the charges that are moved through the photoconductive layer so there is in effect a time integration of the radiation energy received by the photoconductive layer. FIG. 2 is provided to show the final disposition of charges in response to the imaging radiation that is absorbed by the photoconductive layer.

After the electrostatic image is established, it is readout by connecting the D.C. voltage source 50 in series with the readout electronics 40 across the conductor layers 21 and 24 by positioning the switch 60 with the movable contact 63 in contact with the fixed contact 62. As illustrated in FIG. 3, scanning radiation presenting a small cross sectional area, schematically depicted at 70, is progressively directed to areas of the layer 21 in timed relationship to the operation of the readout electronics which receives electrical signals indicative of the charge flow that takes place at an area of the device to which the scanning radiation is directed. In this manner, a point by point readout in the form of electrical signals is obtained for the electrostatic image that was formed. Accordingly, when the scanning radiation is directed to an area where the entire charge for the electrostatic charge image is at the upper surface of the photoconductive layer 22, no electrical signal is produced so long as the voltage provided by the D.C. voltage source 50 is unchanged. Similarly, when the scanning radiation is directed to an area where no imaging radiation was received by the photoconductive layer 22, the charge that was present at the outer surface of layer 22 is transferred to the upper surface of layer 22. Further, since the readout radiation has caused the conductivity of the photoconductive layer 22 at such area to increase reducing the effective thickness of the capacitor provided between the two conductor layers 21 and 24, the presence of a uniform D.C. voltage across the device 20 requires that additional charge flow to maintain such voltage. This additional charge flow increases the electrical signal presented to the readout electronics 40 for the area then being scanned. The magnitude of the readout signal produced by the scanning process for a given area of device 20 will, of course, vary inversely with the amount of imaging radiation that was received by such area.

Rather than moving a small area beam of scanning radiation over the surface of the layer 21 to provide a readout on a point by point basis, a line of radiation may be used. In this case, the conductor layer 21 is not a continuous sheet as is required for the point by point scan, but is formed as shown in FIG. 4, which is a top plan view of the layer, wherein parallel, spaced apart conductors 25 are carried by a supporting substrate 26 with conductors 25 and the substrate arranged so they are transparent to the radiation incident from that side. FIG. 4 also shows the electrical connections 27, one for each conductor 25, that are made to the readout electronics 40. The line of radiation is oriented to be directed transversely to the conductors 25 and, with such orientation maintained, is moved longitudinally of the conductors 25. In this case, electrical signals are applied and entered into the readout electronics in parallel in timed relationship to the movement of the line of radiation longitudinally of the conductors 25.

Further appreciation and understanding of the invention can be obtained by considering FIG. **4*a* of the drawings which pictorially depicts the amount of charge flow through the circuit external to the imaging device 20** as a function of the total radiation exposure for a unit area of the device.

The solid curve, which is characteristic of the imaging device of the type used in the system of FIG. 1, is initially substantially linear for small exposures and then saturates for larger exposures. Point A on the curve depicts the charge flow due to an imaging exposure received at a unit area of the device that is to be read out. Point A on the curve for any selected unit area of the device is determined by the time integrated imaging radiation exposure that is received for such unit area. Upon readout, the unit area receives further radiation exposure causing an additional charge flow to bring the total charge flow for the unit area to point B. It is the additional charge flow (readout charge flow) represented by FIG. **4*a*** in going from A to B for a given unit area to be readout that is recorded by the utilization electronics during readout. By using a readout exposure that is sufficiently high so as to bring point B for any unit area of the device to above the linear portion of the curve, the readout charge flow will be different for unit areas receiving different imaging exposure to provide signals indicative of the radiation image to which the device is exposed. If the readout exposure were so low as to cause the operation of the device to remain in the linear portion of the curve for each unit area, the readout charge flow for each unit area readout would be substantially the same. It can also be appreciated that if the imaging exposure were such that each unit area of the device provided an operating point A that was on the linear portion of the curve, the readout charge flow would bear a substantially linear relationship to imaging exposure received by the various unit areas of the device.

The system and method of this invention permits other forms for the imaging device to be used such as that shown in FIG. 5 wherein the device is as shown in FIG. 1, but with the addition of a second photoconductive insulative layer 28 positioned between the conductor layer 24 and the insulative layer 23. The imaging device 20 of FIG. 5 is shown connected in the system to the D.C. voltage source 50, with readout electronics 40, switch 60, a scanner 30 and radiation imaging source 10 provided in the same manner as shown in FIG. 1.

FIG. 5 shows the switch 60 positioned to sensitize the device 20 with the electrical charge distribution schematically shown at the conductor layers 21 and 24. With switch 60 unchanged, the method requires the radiation image to be directed to the device 20 where it is absorbed primarily by the photoconductive insulative layer 28 to increase its conductivity in accordance with the amount of radiation absorbed to cause the charge present at the upper surface of layer 28, where the radiation impinges, to move to the surface of the layer 28 adjacent the insulative layer 23. This action is depicted in FIG. 6. An electrostatic charge image is thereby established at the surface of the photoconductive layer 28 adjacent the insulative layer 23. The system of FIG. 5 in the condition shown in FIG. 6 can then be read out by the use of the scanner 30 and readout electronics 40 in any of the ways described for reading out the electrostatic charge image provided by the system per FIGS. 1–3. The readout status of the system of FIG. 5 is shown in FIG. 7 wherein the switch 60 is shown with the movable contact in contact with the fixed contact 62 to place the D.C. voltage source 50 in series with the readout electronics 40 across the device 20. Readout radiation is schematically shown being applied to the device 20 at layer 21 opposite an unexposed portion of layer 28 and passes to a portion of the photoconductive insulative layer 22 where it is absorbed. The portion of photoconductive layer 22 being interrogated is made conductive allowing the charge at the lower surface of layer 22 to flow to the upper surface of layer 22. The conductivity that is induced in layer 22 reduces the effective thickness of the capacitor between layers 21 and 24 so additional charge flow occurs to maintain the uniform D.C. voltage that is presented to the device 20. When scanning, radiation is applied to interrogate an area of the photoconductive insulative layer 22 opposite an area of photoconductive layer 28 which received imaging radiation. A similar charge flow takes place, except in this case, the effective thickness of the capacitor associated with such interrogated area is reduced due to the increased conductivity the imaging radiation induced in layer 28, plus the conductivity induced in layer 22 by the scanning radiation so that the additional charge flow which occurs is greater than the additional charge flow that occurs when an area of layer 22 opposite an unexposed area of layer 28 is scanned. Accordingly, the charge flow for each scanned area of layer 21 produces electrical signals which are sensed by the readout electronics and which vary in magnitude dependent on the imaging radiation that was received by layer 28 opposite the interrogated areas of layer 21. The larger the electrical signal for an interrogated area, the greater the imaging radiation that was received by the corresponding area of layer 28. In the case of the device 20 used in the system per FIGS. 1–3, the opposite was true with respect to the readout signals obtained, i.e., the largest electrical signal is obtained when an area of layer 21 in FIG. 3 is interrogated by scanning radiation which is opposite an area of layer 23 which did not receive any imaging radiation.

A further embodiment of the invention is shown in FIG. 8 where a radiation sensitive imaging device 20.1 is used which provides a system that is useful in those cases where the radiation image is provided by x-rays. The radiation sensitive imaging device 20.1 is not a completely unitary sandwiched structure as was that case for the device 20 of FIG. 1, though, like the device 20, it does have three contiguous layers which include a conductive layer 21.1, an insulative photoconductive layer 22.1 and an insulative layer 23.1. A conductive layer 24.1 is provided which, when the device is in condition for having a radiation image applied for establishing an electrostatic charge image, is spaced from the insulative layer 23.1 with such space filled with a fluid, such as a gas or a liquid, that absorbs x-rays to produce electrons and ions. During the readout of the electrostatic charge image that can be provided by the system in FIG. 8, the conductive layer 24.1 and the insulative layer 23.1 are brought into intimate contact with one another. The device 20.1 being employed in this manner requires that it be mounted in a suitable housing (not shown) in order that the gas or liquid that is used can be introduced and removed.

As is the case with the other systems that have been described, the system of FIG. 8 utilizes a D.C. voltage source 50, readout electronics 40, scanner 30 and a switch 60. The various connections for these items are the same as utilized in connection with the system of FIG. 1 and FIG. 5 with the D.C. voltage source being connected to the conductive layer or sheet 24.1 and the movable contact 63 of switch 60 connected to the conductor layer 21.1.

Sensitization of the imaging device 20.1 to prepare it for receiving an x-ray image from the radiation image source 10.1 is carried out by operating switch 60 to place the movable contact 63 in contact with fixed contact 61 as shown in FIG. 8 to cause charges to be provided on the conductor layer 24.1 with opposite charges presented at the conductor layer 21.1.

With the position of switch 60 unchanged, the method for using the system of FIG. 8 requires an x-ray image to be provided and directed toward the conductor layer 24.1 of the device 20.1. The material used for the conductor layer 24.1 is selected to pass the x-ray image with the gas or liquid provided in the space between the layer 24.1 and the insulative layer 23.1 absorbing the x-ray image to produce electrons or ions which move to the upper surface of the insulative layer 23.1 to establish an electrostatic charge image at the upper surface of the insulative layer in accordance with the x-ray image. This imaging step of the method that is involved is illustrated in FIG. 9. The effective thickness of the capacitor provided between the conductor layers 21.1 and 24.1 is reduced by the radiation that is absorbed by the gas, which, with the presentment of the uniform D.C. voltage at the conductive layer 24.1, requires an additional charge flow in the areas where x-ray energy is absorbed. FIG. 9 is illustrative of the final disposition of charges that is provided in response to the x-ray image.

The imaging device 20.1 is then isolated from the D.C. voltage source 50. Preparatory to moving the conductive layer 24.1 into electrical contact with the insulative layer 23.1, the device is then flooded with radiation which passes through the conductive layer 21.1 or 24.1 and is absorbed in the photoconductive layer 22.1 to cause the electrical charges residing at the conductor layer 21.1 to migrate to the upper surface of the photoconductive layer 22.1. If this preparatory step were not used, the charge pattern at layer 23.1 would be lost when conductive layer 24.1 is brought into electrical contact with layer 23.1. This conditioning step is illustrated in FIG. 10. As shown in FIG. 10, this conditioning step serves to move the charge pattern at the conductive layer 21.1 through the photoconductive insulative layer 22.1 to the insulative layer 23.1. It can be seen that such conditioning step could be carried out at the same time that the imaging step is being done, if desired.

The next step requires that the conductive layer 24.1 and the insulative layer 23.1 be positioned so the layer 24.1 is in good electrical contact with the upper surface of the insulative layer 23.1. The voltage level from the D.C. voltage source 50 is adjusted to provide a readout electrical field across the photoconductive layer 22.1 and the switch 60 is reconnected to the imaging device 20.1 with the switch 60 operated so the movable contact 63 is in contact with the fixed contact 62 to place the D.C. voltage source 50 and the readout electronics 40 in series across the conductor layers 21.1 and 24.1. A scanning step, such as those described in connection with the system of FIG. 1, is then carried out to provide electrical signals to the readout electronics 40 in accordance with the electrostatic charge image that was provided by the device 20.1. The magnitude of the electrical signals provided to the readout electronics 40 are very much larger than those that would be provided were the conductive layer 24.1 not repositioned prior to the scanning step, since the elimination of the gas or liquid filled space between layer 24.1 and the insulative layer 23.1 uniformly reduces the thickness of the capacitor to require more charge flow during the readout than would take place if the space were retained.

Readout signals, which are very much larger than those that would be provided were the conductive layer 24.1 not repositioned prior to the scanning step, can be obtained with the step requiring that the device 20.1 be flooded with radiation eliminated, if the layer 24.1 is moved very close to, but not into, electrical contact with layer 23.1 prior to the scanning step. In such case, the various steps in the method are illustrated by FIGS. 8, 9 and 12. The readout would take place as explained for FIG. 7.

The arrangement and method just described, wherein the conductive layer 24.1 is moved very close to, but not into, electrical contact with the insulative layer 23.1 prior to the scanning step, is also applicable to an arrangement and method wherein the multi-layered device 20.1 does not have an insulative layer 23.1. Such an arrangement is shown in FIG. 13, which is similar to that shown in FIG. 8, but with the insulative layer 23.1 eliminated. The reference numerals used in FIG. 8 are used in FIG. 13 to identify like structure. The method using the device 20.1 of FIG. 8 for forming an electrostatic charge image in response to x-ray imaging radiation is as described for FIGS. 8 and 9, in which case the electrostatic charge image is formed at the juncture of the gas or liquid layer and the photoconductive insulative 22.1. The conductive layer 24.1 is moved closer to, but not into, electrical contact with the photoconductive insulative layer 22.1 prior to the scanning step. Scanning radiation directed to an exposed area of the device will cause the image charge at the photoconductive layer 22.1 to be cancelled and cause the capacitor established between the photoconductive layer 22.1 and the conductive layer 24.1 to become charged. Scanning radiation directed to an unexposed area will cause charge flow of a lesser amount than that obtained with respect to an exposed area.

The devices that have been described are reusable and are placed in their original condition for reuse by connecting the two conductive electrodes directly to each other and with such connection present subjecting the device to radiation to which it is sensitive.

Several characteristics regarding the various layers for the devices that have been discussed should be considered for constructing a usable device in systems utilizing this invention. Since the method of this invention is carried out over a period of time, it is desirable that deterioration of the various electrical fields that are established during the process be held to a minimum. It is desirable, therefore, that the junction at conductive layer 21 (21.1) and the insulative photoconductive layer 22 (22.1) interface be an electrical blocking contact, i.e., a contact that will allow so few charges to be injected from the conductive layer into the photoconductive layer that the initial applied voltage across the photoconductive layer can be maintained (in the absence of radiation) for a time period that is much greater than the total time used between the initial sensitizing step and the readout step. Such a contact is obtained, for example, when indium oxide is used as the conductor and the photoconductive material included in the photoconductive layer is amorphous selenium, lead oxide or cadmium sulfide. The conductive layer of indium oxide is conveniently provided as a coating on glass, which form is commercially available. The Pittsburgh Plate Glass Company, Pittsburgh, Pa., sells such structure under the tradename, Nesatron. The glass will also serve to provide a support for the remaining layers of the device. The photoconductive insulative layer 22 (22.1) should have a low conductivity in the dark so it will maintain the electric field. It preferably should have a resistivity of about $10^9$ ohm-centimeters or greater. It is also desirable that the insulative layer 23 (23.1) have a resistivity of about $10^9$ ohm-centimeters or greater and maintain the voltage applied across it for a time period that is much greater than the total time used between the initial sensitizing step and the readout step. When the device is to be used with x-ray images, the insulator selected should be one which does not appreciably absorb the x-rays. Polyesters can be used as well as poly-p-xylylene. The minimum thickness for the photoconductive layer is about ½ micron with the maxium thickness about 1000 microns.

The following examples are provided to illustrate the invention.

EXAMPLE 1

A device 20 as described in connection with FIG. 1 with a conductive layer 21 as described in connection with FIG. 4 is utilized. On the indium oxide side of a 8.18 cm. by 7.62 cm. piece of Nesatron glass (trademark of Pittsburgh Plate Glass Company) 64 line electrodes 0.75 mm. wide spaced 0.25 mm. apart are produced by conventional photolithographic and etch techniques to provide the conductive layer 21. The glass is then cleaned and inserted into a standard vacuum system such that the conductive electrodes face a crucible evaporation source loaded with selenium (Se). The vacuum system is pumped to about $5\times10^{-5}$ torr and an approximately 40 microns thick film of amorphous selenium evaporated onto the conductive electrode face of the glass to provide the photoconductive insulative layer 22. Prior to the evaporation step, the substrate to source distance is adjusted to 20 centimeters to prevent crystallization of the selenium due to heat from the evaporation source. After removal from the vacuum system, the insulative layer 23 of the device 20 is provided by vapor depositing a 12 to 25 micron thick layer of poly-p-xylylene on the selenium layer. The conductive layer 24 is then provided by an evaporated gold film that is deposited on the insulative layer 23.

In this example, if visible light is used, the imaging and readout steps of the method of this invention are carried out by directing the light image and the readout radiation through the glass support for the layer 21. The sensitizing, imaging and readout are implemented in accordance with the detailed description that has been given. In this example, an applied voltage of 1000 volts is provided by the D.C. voltage source 50 with the negative output applied to the conductive layer 24. When using x-rays to image, a conventional x-ray tube is operated at 90 kev with a 360 ma second exposure. Line readout readiation is provided by a 457.9 nanometers laser line of an argon laser directed through cross cylindrical lenses to form an approximate 50 micron wide line of light. The readout signal is processed to provide an intensity modulated display on a cathode ray tube that is an accurate representation of the x-ray image. The device is erased by exposing the device to light while the two electrodes are connected. The device can then be reused.

EXAMPLE 2

In this example a device 20 as described in connection with FIG. 1 with a conductive layer 21 as described in connection with FIG. 4 is utilized. A piece of polyester 5 cm.×8 cm. on which an aluminum film is deposited provides the insulative layer 23 and the conductive layer 24, respectively. A layer approximately 50 microns thick of lead oxide (PbO) pigment in an organic binder such as a copolymer of butadiene and styrene is knife coated on the layer 23 to provide the photoconductive insulative layer 22. A pigment to binder ratio of 10 to 1 by weight is used. Carbon black stripes 1.6 mm. wide and spaced 1.6 mm. apart are painted on the layer 22 to provide layer 21. Imaging and readout are accomplished as described in Example 1.

What is claimed is:

1. A system for establishing an electrostatic charge image and then providing a readout of the image including a multi-layered photoconductive device including a first conductive layer, an insulative layer, a photoconductive insulative layer and a second conductive layer in that order wherein at least the latter three layers are successively contiguous; a D.C. voltage source for providing a high electric field between said first and second conductive layers; a radiation image source for exposing the device to a radiation image with the D.C. voltage source operatively connected between said first and second conductive layers to produce an electrostatic charge image at a layer of the device; and a scanner for scanning the device with readout radiation and readout electronics operatively connected in series with said D.C. voltage source, such series combination operatively connected between said first and second conductive layers when the scanner is scanning the device whereby the readout electronics detects the charge flow caused by readout radiation from said scanner.

2. The system according to claim 1 wherein the radiation image source provides an x-ray image, the device includes an x-ray absorbing fluid layer provided between said first conductive layer and said insulative layer when the device receives a radiation image from the radiation image source, said device presented with said first conductive layer in contact with said insulative layer when the device is scanned by the scanner.

3. The system according to claim 1 wherein all layers of said photoconductive device are successively contiguous.

4. The system according to claim 1 wherein a photoconductive insulative layer sensitive to the imaging radiation is provided between and contiguous to said first conductive layer and said insulative layer; said first conductive layer is substantially transparent to the radiation provided by said radiation image source; said device is positioned so said last-mentioned photoconductive insulative layer receives the image radiation via said first conductive layer; said second conductive layer is substantially transparent to the readout radiation; and said scanner is positioned to provide readout radiation to the first-mentioned photoconductive insulative layer via said second conductive layer.

5. The system according to claim 1 wherein said second conductive layer includes a plurality of parallel conductive strips.

6. A method for establishing an electrostatic charge image and then providing a readout of the image including the steps of exposing a multi-layered photoconductive device having a first conductive layer, an insulative layer, a photoconductive insulative layer and a second conductive layer in that order, wherein at least the three latter layers are successively contiguous, to a radiation image while a D.C. voltage is applied to the device to establish a high electric field between the first and second conductive layers to produce an electrostatic image at a layer of the device and providing for the scanning of the device with readout radiation with readout electronics provided and operatively connected in series with the D.C. voltage and such series combination connected between the first and second conductive layers for detecting charge flow caused by the readout radiation as it scans the device.

7. The method according to claim 6 wherein the radiation image provided is an x-ray image, said step of exposing is carried out with an x-ray absorbing fluid layer provided between said first conductive layer and said insulative layer during the exposure of the device to the x-ray image and prior to said readout step, positioning said first conductive layer closer to said insulative layer.

8. The method according to claim 7 wherein said first conductive layer when positioned closer to said insulative layer is in electrical contact with said insulative layer and during or after the exposure step the photoconductive device is isolated from the D.C. voltage and is flooded by radiation which is absorbed by the photoconductive insulative layer.

9. The method according to claim 6 wherein all layers of said photoconductive device are successively contiguous.

10. The method according to claim 6 wherein said photoconductive insulative device includes a photoconductive insulative layer between and contiguous to said first conductive layer and said insulative layer; said first conductive layer is substantially transparent to the radiation provided by said radiation image source; said device is positioned so said last-mentioned photoconductive insulative layer receives the image radiation via said first conductive layer; said second conductive layer is substantially transparent to the readout radiation; and said scanner is positioned to provide readout radiation to the first-mentioned photoconductive insulative layer via said second conductive layer.

11. A system for establishing an electrostatic charge image and then providing a readout of the image including a multi-layered photoconductive device; a D.C. voltage source for providing a high electric field between two layers of said device; a radiation image source for exposing the device to a radiation image with the D.C. voltage source operatively applied between said two layers to produce an electrostatic charge image at a layer of the device; a scanner for scanning the device with readout radiation and readout electronics operatively connected in series with said D.C. voltage source, such series combination operatively connected between said two layers when the scanner is scanning the device whereby the readout electronics detects the charge flow caused by readout radiation from said scanner; and said device, including a first conductive layer as one of said two layers, an x-ray absorbing fluid layer, a photoconductive insulative layer and a second conductive layer as the other of said two layers in that order, with said first conductive layer having two positions, one of said two positions used when said radiation source is operated and the other of said two positions used, which positions said first conductive layer closer to, but not in, electrical contact with said photoconductive insulative layer, when said device is scanned with said readout radiation.

12. The system according to claim 11 wherein said second conductive layer includes a plurality of parallel conductive strips.

13. A method for establishing an electrostatic charge image and then providing a readout of the image including the steps of exposing a multi-layered photoconductive device having a first conductive layer, an x-ray absorbing fluid layer, a photoconductive insulative layer and a second conductive layer in that order, to a radiation image while a D.C. voltage is applied to the device to establish a high electric field between the first and second conductive layers to produce an electrostatic image at a layer of the device, after the step of exposing said device to radiation image, positioning said first conductive layer closer to, but not in, electrical contact with said photoconductive layer, and providing for the scanning of said device with readout radiation with readout electronics provided and operatively connected in series with the D.C. voltage and such series combination connected between the first and second conductive layers for detecting charge flow caused by the readout radiation as it scans said device.

14. The system according to claim 1 wherein the radiation image source provides an x-ray image, the device includes an x-ray absorbing fluid layer provided between said first conductive layer and said insulative layer when the device receives a radiation image from the radiation image source, said device presented with said first conductive layer into close proximity with said insulative layer when the device is scanned by the scanner.

* * * * *